US005779572A

United States Patent [19]

Dicerbo

[11] Patent Number: 5,779,572

[45] Date of Patent: Jul. 14, 1998

[54] SPORTS RACKET

[75] Inventor: Charles Dicerbo, Concord, Canada

[73] Assignee: Boz Sports International Ltd., Toronto, Canada

[21] Appl. No.: 837,785

[22] Filed: Apr. 22, 1997

[51] Int. Cl.[6] ..... A63B 49/02

[52] U.S. Cl. ..... 473/521

[58] Field of Search ..... 473/546, 539, 473/520, 521, 522, 543, 534

[56] References Cited

U.S. PATENT DOCUMENTS

| | | | |
|---|---|---|---|
| 4,828,260 | 5/1989 | Todd | 473/521 |
| 4,889,338 | 12/1989 | Keijiro | 473/546 |
| 4,995,608 | 2/1991 | Von Hackewitz | 473/534 |
| 5,029,857 | 7/1991 | Von Hackewitz | 473/534 |
| 5,133,552 | 7/1992 | Feeney et al. | 473/546 X |
| 5,178,386 | 1/1993 | Tzeng | 473/521 |
| 5,226,651 | 7/1993 | Du Gardin | 473/521 |
| 5,322,278 | 6/1994 | Jeanrot | 473/521 |
| 5,350,173 | 9/1994 | DiCerbo | 473/521 |

*Primary Examiner*—Raleigh W. Chiu
*Attorney, Agent, or Firm*—Dowell & Dowell, P.C.

[57] ABSTRACT

This invention relates to an improvement in a split bridge sports racket having a frame with a rim and a handle, the rim being formed with string tunnels through which the string extends to form an impact surface, the handle having a Y configuration, the arms of which merge with the rim to define a bridge section of the rim that extends between the ends of the arms of the Y configuration, the bridge having a discontinuity, the free ends of the bridge at the discontinuity articulating with a bridge insert to reduce player arm stress in use. The improvement resides in providing a bridge having a length to accommodate at least four central longitudinal string tunnels of the racket with each central longitudinal string tunnel extending in the same direction as their respective longitudinal strings through the said bridge and wherein a support plug is mounted within the hollow of each of the free ends of the bridge to limit the movement of the free ends during play and prevent cracking of the frame from use.

3 Claims, 4 Drawing Sheets

SPORTS RACKET

This application relates to a sports racket of the type used in a as tennis, racket ball or squash, and having a split-frame.

Split-frame rackets of the type having a discontinuous rim plugged with a resilient insert are not new. They were developed to increase the size of the sweet spot on the stringed face of the racket and to lessen the impact transferred through the racket from the ball to the arm of the player. The split frame and resilient insert allowed the rim of the racket head to flex more than it would otherwise and absorb some of the impact that would have otherwise been felt by the player's arm into the racket head. The split frame represents an advance in the art of racket sports for those reasons.

An example of a split-frame racket is as taught in the inventor's prior U.S. Pat. No. 5,350,173.

Split frame rackets are pressure-moulded and, as well, they are hollow because of weight considerations.

In the design of split-frame rackets, it is acknowledged that the split bridge of the racket is less structurally strong than the continuous bridge of a conventional racket and that compensation for this difference has to be made in the design of the racket. Otherwise, the repeated impact of a high velocity ball, during play, would cause breakage of the racket. It is for this reason that all split-frame rackets made to date have been made by splitting the rim at its central bridge area and designing the string arrangement so that no more than two string tunnels go directly through the bridge, with the adjacent string tunnels being directed to the side of the racket head. If the strings are not directed to the side, the free ends of the racket rim would move too much during play.

However, it has become apparent over time that the split-frame racket, for all of its advantages, does have a serious drawback. The stress caused by the impact which has been re-directed from the player's arm back to the racket has caused a higher incidence of string breakage. The stress has been successfully re-directed, but too much of that re-directed stress has then been borne by the strings. For instance, it would not be uncommon for a person of professional calibre to have to re-string their split-frame racket after only about two hours of play because of string breakage. Using a non-split frame, the same player would only have to re-string after about eight hours of play.

As long as the split-frame racket has been available, which has been a substantial number of years, this problem has persisted. The present invention, however, provides a satisfactory solution.

It is an object of the present invention to provide a string racket with a split frame that lessens the problem of string breakage, while still maintaining the advantages of a split-frame racket.

According to an aspect of the present invention, there is provided in a split bridge sports racket having a hollow frame with a rim and a handle, the rim being formed with string tunnels through which the string extends to form an impact surface, the handle having a Y configuration, the arms of which merge with the rim to define a bridge section of the rim that extends between the ends of the arms of the Y configuration, the bridge having a discontinuity, the free ends of the bridge at the discontinuity articulating with a bridge insert to reduce player arm stress in use, the improvement of a bridge having a length to accommodate at least four central longitudinal string tunnels of the racket; each of said central longitudinal string tunnels extending in the same direction as its respective longitudinal string through the said bridge; and wherein a support plug is mounted within the hollow of each of the free ends of the bridge to limit movement of the free ends of the bridge during play and prevent cracking of the frame from use.

The invention will be more clearly understood after reference to the following specification given in conjunction with the drawings in which.

Figure 1:
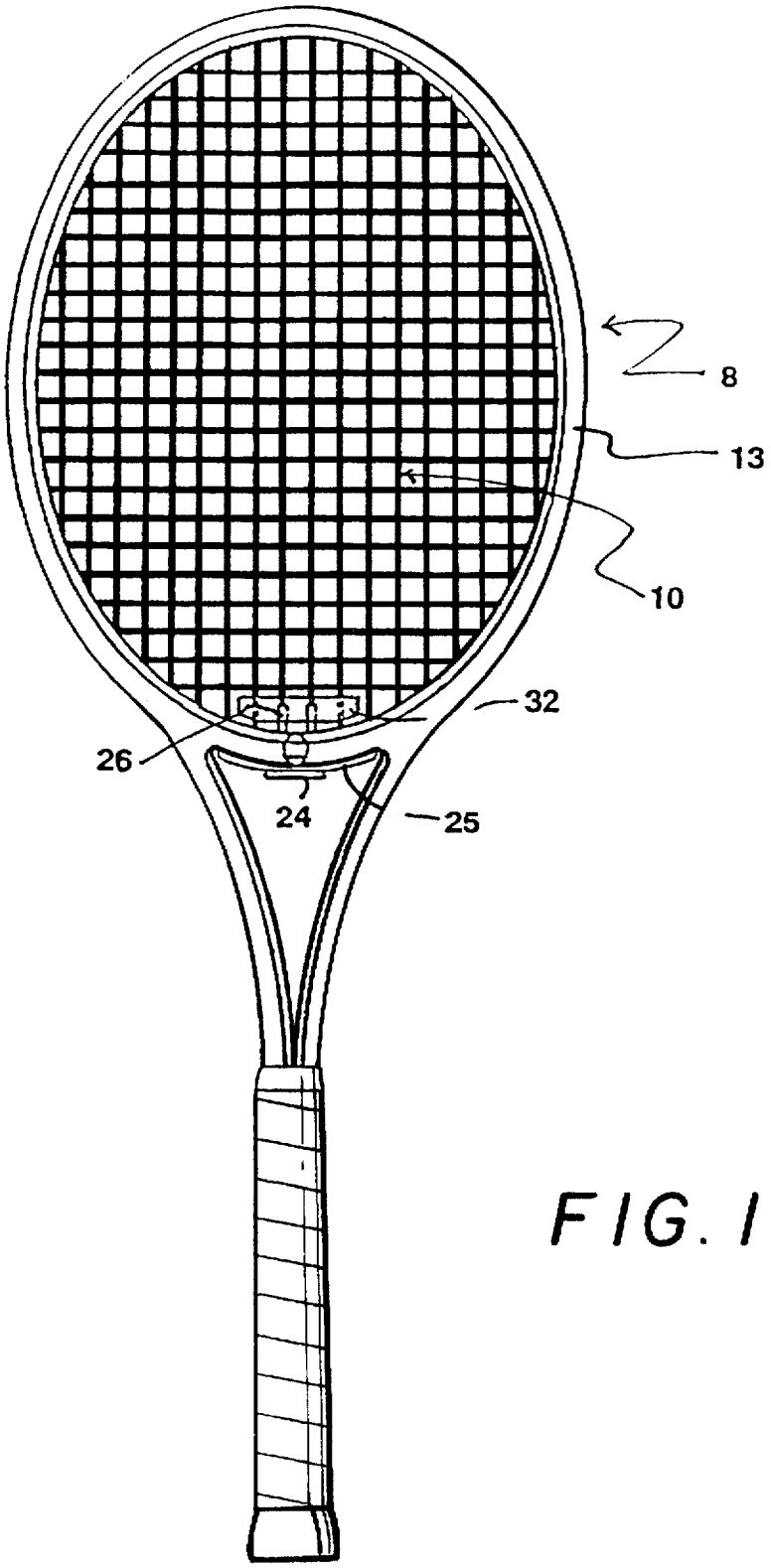
FIG. 1 is an illustration of a front view of the preferred embodiment of the present invention.
Figure 2:
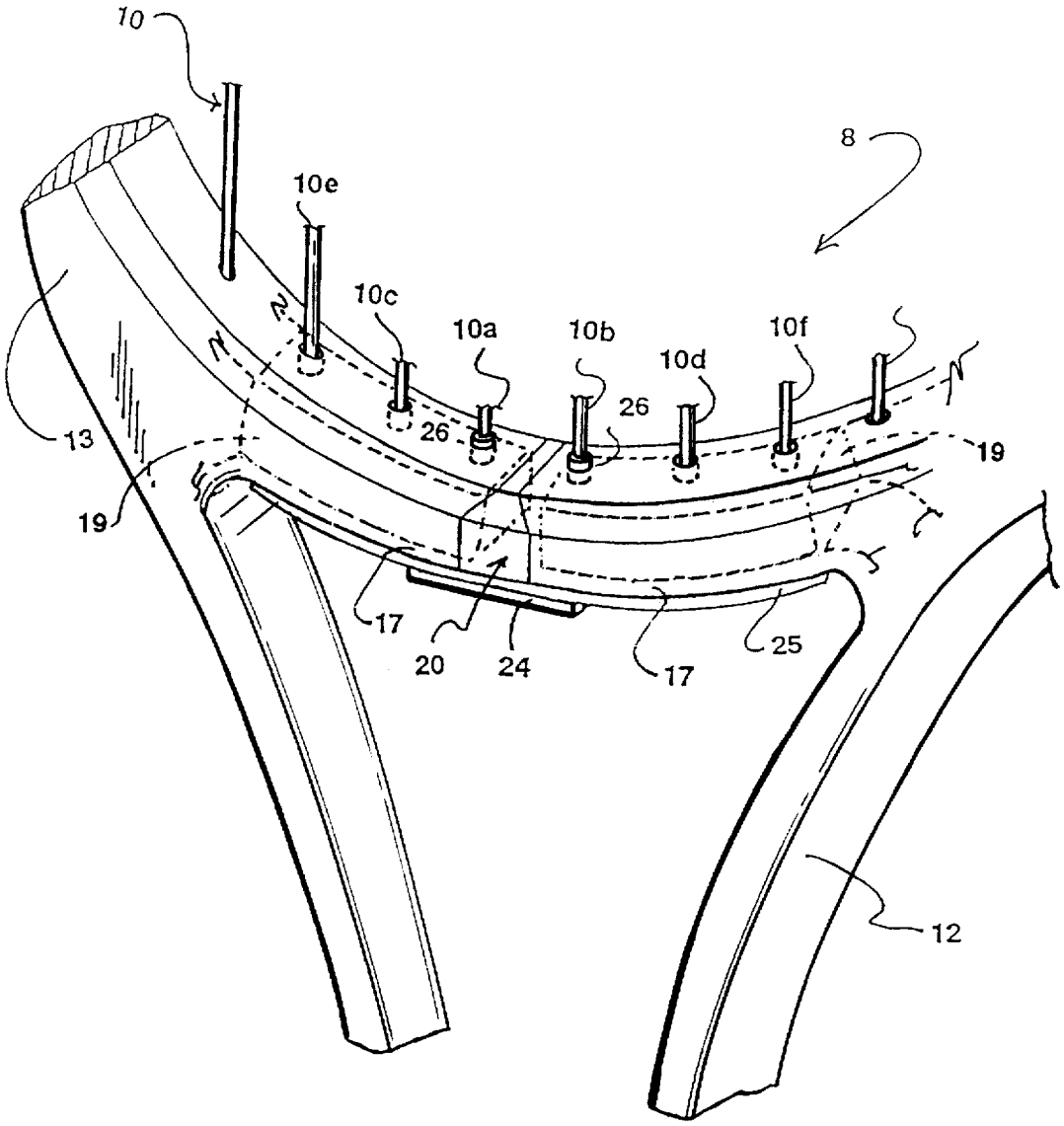
FIG. 2 is an illustration of a partial perspective view of the preferred embodiment of the invention.
Figure 3:
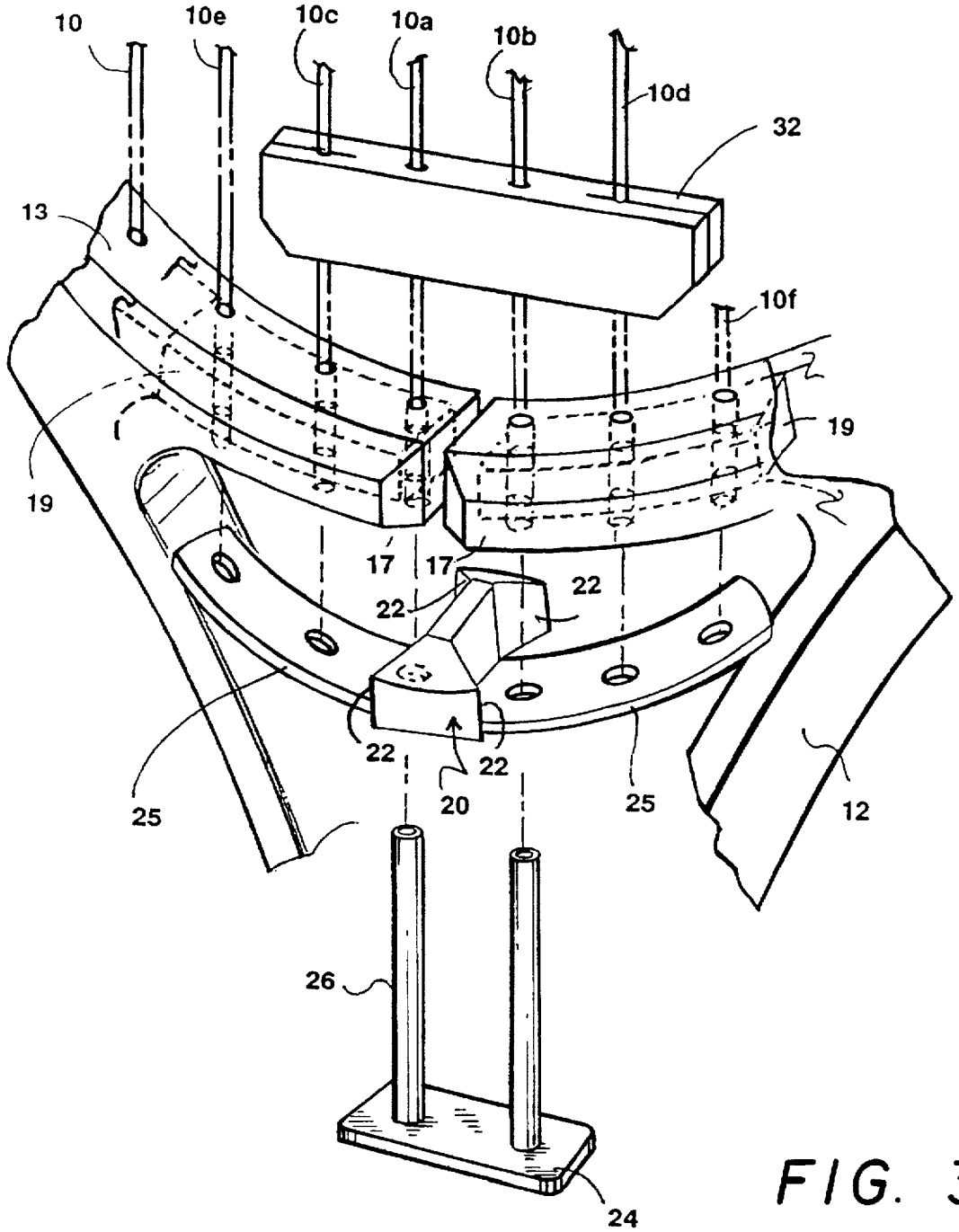
FIG. 3 is an illustration showing the parts used in the manufacture of the preferred embodiment.

Referring to the embodiment illustrated in FIGS. 1 to 3, there is shown a racket generally referred to by the numeral 8, strung under pressure with strings generally indicated by the numeral 10 of the conventional type. The racket frame has a Y-shaped handle 12 and a head with a rim 13 that has a discontinuity at its bridge portion to provide two spaced free ends 17.

Within the hollow of each of the free ends of the bridge, there is mounted a support plug 19. Each support plug 19 limits the misshaping of its free end during play. Without this feature, the problem of the prior art, namely the cracking of the frame, would persist.

Figure 4:
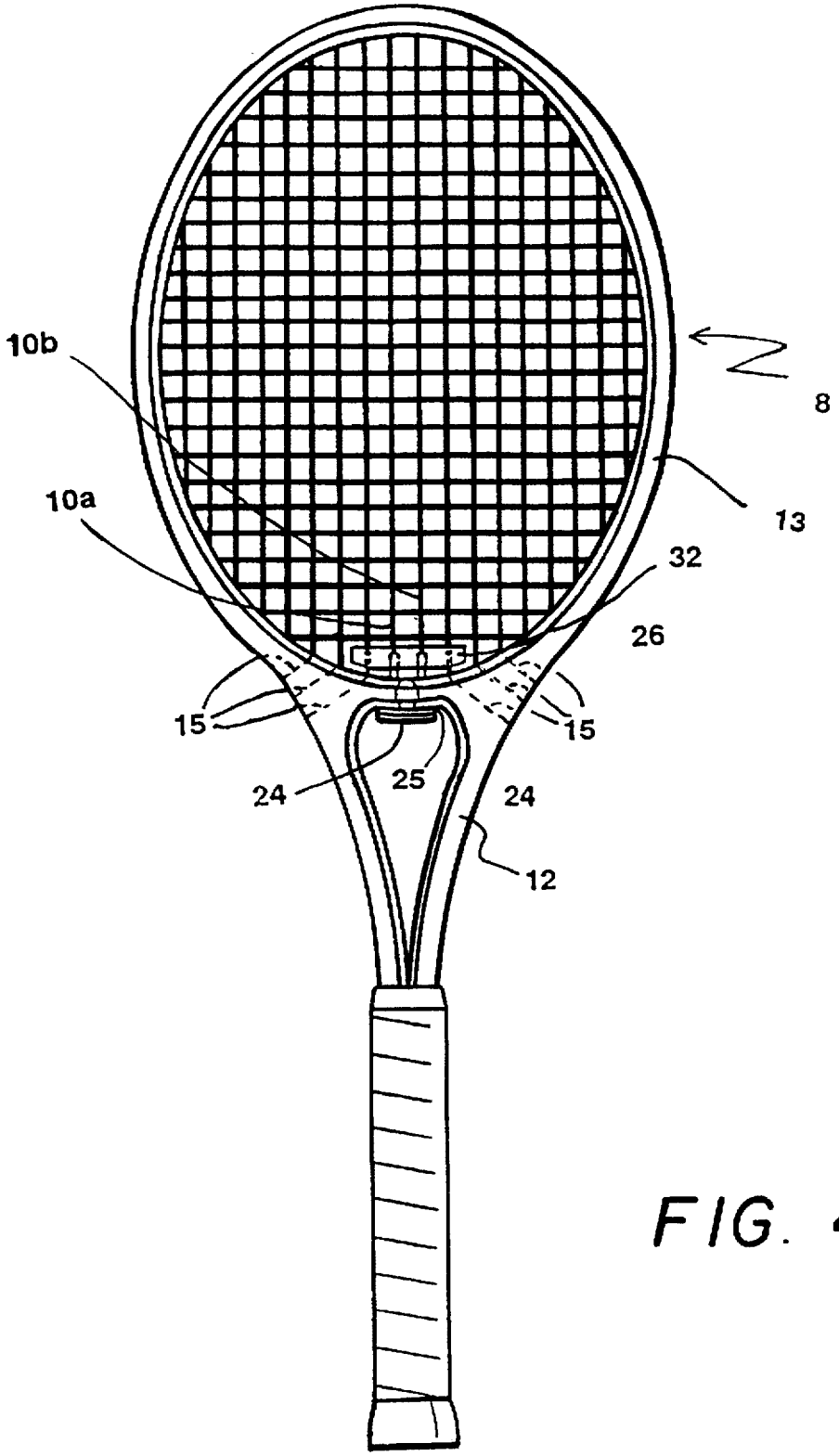
FIG. 4 is an illustration of a racket having a split frame of the type that has been used prior to this invention, with the stringing extending through the bridge portion illustrated in phantom.

The embodiment of an old style split-frame racket, of the type available, and illustrated in FIG. 4, with its comparable parts similarly numbered.

The difference between the embodiment of FIG. 4 and the embodiment of FIGS. 1 to 3 are twofold. Firstly, there are only two longitudinal string tunnels 15 extending the same direction as their respective longitudinal string lengths, numbered 10*a* and 10*b*, through the free ends 17 at the bridge in the FIG. 4 embodiment. Secondly, there are no support plugs 19 in the FIG. 4 embodiment. But in the embodiment shown in FIGS. 1 to 3, there are six string tunnels 16 extending in the same direction as their respective longitudinal string lengths through the free ends 17 at the bridge. And there are support plugs 19.

In FIG. 4, it would not be possible to direct more than two longitudinally-extending string tunnels through the bridge because such redirection would eventually lead to breakage of the bridge as described above. The string tunnels 15 are therefore directed to the side, as shown in phantom.

In the racket of this invention, by redirecting the stringing, it has been found that the stress exerted on the strings 10 on impact is reduced because there is less redirection and less breakage of the strings 10 occur. However, the advantages of a bigger sweet spot and reduction of the impact transferred to the player's arm remain. Also, with the support plugs 19, the racket frame remains strong enough and a better playing racket without significant risk of bridge breakage.

The insert, generally referred to by the numeral 20, is transversely sloped at surfaces 22 which are designed to permit 74 the ends 17 to bend laterally of the plane of the rim of the racket head upon impact of a ball during play. A significant modification now possible with the current invention is the lengthening of the strip member 25, further spreading the stress resulting from the impact of the ball during play. In the prior art, as illustrated in FIG. 4, the strip member 25 is of a more limited length, not providing the same spreadout of stress.

The lower outer strip member 24, as is the case in both the prior art and the preferred embodiment of this invention, is formed with sheaths 26 that extend from the strip member and secure the insert 20 in the racket.

The stringing of the racket, shown in the preferred embodiment, is conventional. The strip member 24 is held in place in the racket by the tension of the string lengths 10*a*, 10*b*, 10*c*, 10*d*, 10*e* and 10*f* of string 10 which extends through and around the rim and is continuous.

Mounted around the free ends of sheaths 30 is a shock absorbing clamp member 32. The clamping member 32 overlaps the strings of the racket and the free ends of the sheaths 30 to transfer, during play, vibrations for the impact of a ball through the sheaths 26 and strip member 24 to the insert 20.

The insert 20 (but not the lengthening of strip member 25), the clamping member 32 and the strip member 24 with sheaths 26 are all components of the prior art.

The support plug in the preferred embodiment is made from wood, but other suitable materials will be apparent. For instance, a plastics material having the desired physical characteristics could also be used. The purpose of the insert is to provide the support necessary to restrict movement of the inner free ends 17 enough to prevent cracking. The most preferable materials are therefore those which have both the necessary structural strength and are relatively light in weight.

In result of the modifications made in the direction of the string tunnels and the restructuring of the bridge area of the racket, there is less string breakage while still maintaining the advantages of a split-frame racket.

It will be apparent to those skilled in the art that modifications to the preferred embodiment illustrated above will be possible without deviating from the substance of the invention as claimed in the appended claims. It is not intended that the description of the invention provided in this specification be read in a limiting sense. The illustrated design is a preferred one but is given by way of example only and not with the intention that it define the limits of the application of the principles of the invention to other designs.

The embodiments of the invention in which an exclusive property or privilege is claimed are defined as follows:

1. In a split bridge sports racket having a hollow frame with a rim and a handle, the rim being formed with string tunnels through which the string extends to form an impact surface, the handle having a Y configuration, the arms of which merge with the rim to define a bridge section of the rim that extends between the ends of the arms of the Y configuration, the bridge having a discontinuity, the free ends of the bridge at the discontinuity articulating with a bridge insert to reduce player arm stress in use, the improvement of a bridge having a length to accommodate at least four central longitudinal string tunnels of the racket; each of said central longitudinal string tunnels extending in the same direction as its respective longitudinal string through the said bridge; and wherein a support plug is mounted within the hollow of each of the free ends of the bridge to limit the movement of the free ends during play and prevent cracking of the frame from use.

2. In a split bridge sports racket having a hollow frame with rim and a handle, the rim being formed with string tunnels through which the string extends to form an impact surface, the handle having a Y configuration, the arms of which merge with the rim to define a bridge section of the rim that extends between the ends of the arms of the Y configuration, the bridge having a discontinuity, the free ends of the bridge at the discontinuity articulating with bridge insert to reduce player arm stress in use, the improvement as claimed in claim 1 wherein:

there is provided a strip member to underlie the bridge of the racket, said strip member being of a length to accommodate the string passing through it at least four times.

3. In a split bridge sports racket having a hollow frame with a rim and a handle, the rim being formed with string tunnels through which the string extends to form an impact surface, the handle having a Y configuration, the arms of which merge with the rim to define a bridge section of the rim that extends between the ends of the arms of the Y configuration, the bridge having a discontinuity, the free ends of the bridge at the discontinuity articulating with a bridge insert to reduce player arm stress in use, the improvement as claimed in claim 1 wherein the bridge has a length to accommodate at least six central longitudinal string tunnels of the racket; the said central longitudinal string tunnel extending in the same direction as their respective longitudinal strings through the said bridge.

* * * * *